US007664280B2

(12) United States Patent
Rass

(10) Patent No.: US 7,664,280 B2
(45) Date of Patent: Feb. 16, 2010

(54) HEARING AID HAVING AN OPERATING DEVICE

(75) Inventor: Uwe Rass, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 838 days.

(21) Appl. No.: 11/138,177

(22) Filed: May 26, 2005

(65) Prior Publication Data

US 2005/0281424 A1 Dec. 22, 2005

(30) Foreign Application Priority Data

May 26, 2004 (DE) ..... 10 2004 025 691

(51) Int. Cl.
*H04R 25/00* (2006.01)
*H04R 29/00* (2006.01)

(52) U.S. Cl. ..... 381/315; 381/60; 381/312; 381/314

(58) Field of Classification Search ..... 381/314, 381/315
See application file for complete search history.

(56) References Cited

U.S. PATENT DOCUMENTS 5,202,927 A * 4/1993 Topholm ..... 381/315
5,604,812 A * 2/1997 Meyer ..... 381/314
6,035,050 A * 3/2000 Weinfurtner et al. ..... 381/313
7,428,312 B2 * 9/2008 Meier et al. ..... 381/312
2005/0111680 A1 5/2005 Meier et al.

FOREIGN PATENT DOCUMENTS

EP 0 064 042 A1 11/1982
EP 0 349 835 A1 1/1990
EP 0 814 634 A1 12/1997
EP 1 351 552 A2 10/2003
EP 1 420 611 A1 5/2004
EP 1 432 282 A2 6/2004

* cited by examiner

*Primary Examiner*—Brian Ensey
*Assistant Examiner*—Matthew Eason

(57) ABSTRACT

The operation of a hearing aid (10) or hearing aid system (10, 11) is to be improved. It is proposed here that the acoustic auditory environment in which the hearing aid (10) or hearing aid system (10, 11) is found is analyzed and one of the adjustment functions dependent on the relevant auditory situation is assigned to at least one control element (7; 12-15) as a function of the auditory situation detected in this way. The adjustment possibility of the hearing aid (10) is thereby restricted to the adjustment possibilities which are meaningful to the relevant auditory situation.

5 Claims, 1 Drawing Sheet

HEARING AID HAVING AN OPERATING DEVICE

CROSS REFERENCE TO RELATED APPLICATIONS

This application claims priority to the German application No. 10 2004 025 691.8, filed May 26, 2004 which is incorporated by reference herein in its entirety.

FIELD OF INVENTION

The invention relates to a hearing aid or hearing aid system with an input converter for accepting an input signal and converting said input signal into an electrical signal, a signal processing unit for processing the electrical signal, an output converter for outputting an output signal, an operating device with at least one actuatable control element for adjusting parameters which influence the signal processing in the signal processing unit, and with analysis means for analyzing the input signal.

BACKGROUND OF INVENTION

Known hearing aids have at least one microphone or telecoil for accepting an acoustic and/or electromagnetic input signal and converting the input signal into an electrical signal. Before being supplied to an output converter for outputting an output signal, the electrical signal is processed and amplified as a function of the signal frequency. Electric-acoustic converters (earpieces) are conventionally used as output converters. Nevertheless output converters are also known which emit an output signal in the form of electrical impulses in order to stimulate the nerves or which are directly linked to the ossicles and which stimulate said ossicles to vibrate.

Furthermore known hearing aids comprise operating devices with at least one actuatable control element for adjusting parameters which influence the signal processing in the signal processing unit. Control elements of this type are for example the M-T-O switch (microphone, telecoil, on/off), the volume control or the program selection key. The operating device can however also be designed as a remote control, which comprises several control elements.

A hearing aid with a memory is known from EP 0 064 042 A1, in which several parameter sets (so-called auditory programs) are stored in the hearing aid in order to adjust the signal processing to different auditory situations. A parameter set is selected by actuating a program selection key or by analyzing an acoustic input signal, sa id parameter set then determining the signal processing in the hearing aid.

EP 0 814 634 A1 discloses a programmable hearing aid system for determining optimum parameter sets in a hearing aid. The known hearing aid system comprises an adjusting device comprising a memory for several parameter sets available for adjusting the signal processing to each auditory situation. Furthermore, the known hearing aid system stands out in that several parameter sets are stored for one auditory situation. Several parameter sets can thus be tested for each auditory situation until a parameter set is finally selected for each auditory situation and stored in the hearing aid.

A hearing aid with an actuating element for changing the acoustic amplification setting and with an operating mode switch for two or more operating modes is known from EP 0 349 835 A1. Further adjustment functions can be selected in addition to the actuating element for the acoustic amplification setting by means of the operating mode switch.

An object of the present invention is to simplify the operation of a hearing aid.

SUMMARY OF INVENTION

This object is achieved in a hearing aid or hearing aid system with an input converter for accepting an input signal and converting said input signal into an electrical signal, a signal processing unit for processing the electrical signal, an output converter for outputting an output signal, an operating device with at least one actuatable control element for adjusting parameters which influence the signal processing in the signal processing unit, and with analysis means for analyzing the input signal, such that different adjustment functions are assigned to the control element, depending on the result of the signal analysis.

The basic concept of the invention is thus to offer the user of a hearing aid a plurality of manual adjustment options for the hearing aid but also to design the control as simply as possible. In addition, different adjustment functions are automatically assigned to the control elements as a function of the acoustic environment in which the hearing aid is found at that time. If the hearing aid is provided with a program selection key for example, an automatic program adjustment can take place initially as a result of analyzing the input signal.

By actuating the program selection key, further auditory programs can then be manually selected, with each actuation of the program selection key only switching between those auditory programs which are suited to the auditory situation detected. In this way, the hearing aid wearer can be offered more program alternatives than with known hearing aids, in which the hearing aid wearer would have to use a program selection key to run through a number of auditory programs not suitable for the current auditory situation in order to reach the appropriate settings. The invention restricts the selection to auditory programs suited to the auditory situation.

In using the actuation of a control element to implement an adjustment function the invention is not restricted to the selection of programs. Instead it covers any number of control elements and adjustment functions. By way of example, a control element which normally functions as a volume control can serve to adapt the contrast amplification during the detected auditory situation 'Speech with interference noise'.

The acoustic environment in which the hearing aid is found at that time is analyzed in a known manner by determining characteristic variables which relate to the signal level, the modulation depth or the spectral distribution of an acoustic input signal for instance. In accordance with the invention, an adjustment function meaningful to these auditory environment is assigned to at least one control element, as a function of the detected auditory environment. The control element concerned only allows adjustment functions which are meaningful to this auditory situation to be implemented.

One embodiment of the invention relates to a hearing aid system with a hearing aid and an operating device configured as a remote control. Data is preferably transmitted wirelessly between the remote control and the hearing aid. The acoustic input signal can the also be advantageously analyzed in the remote control in order to determine the auditory environment. The remote control allows more space for accommodating control elements than a hearing aid. It should nevertheless be designed as small as possible and only with a small number of control elements in order to go unnoticed in the pants pockets of the wearer and to improve clarity. By way of example, it includes keys for the direct selection of four auditory programs. According to the invention, these four selection keys are then assigned to the auditory program suited to the auditory situation determined, i.e. when one of the four keys is actuated, one of the four auditory programs suited to the detected auditory situation is activated in the hearing aid.

A development of the invention provides for evaluation of the manual readjustments of the hearing aid carried out by the user in a specific auditory environment. Taking a longer-term perspective, the hearing aid learns the preferences of the relevant user, so that this can be taken into account with the automatic adjustment of the parameters relating to the signal processing. Manual readjustment thus becomes necessary ever more infrequently.

BRIEF DESCRIPTION OF THE DRAWINGS

The invention is described below with reference to exemplary embodiments, in which.

DETAILED DESCRIPTION OF INVENTION

Figure 1:
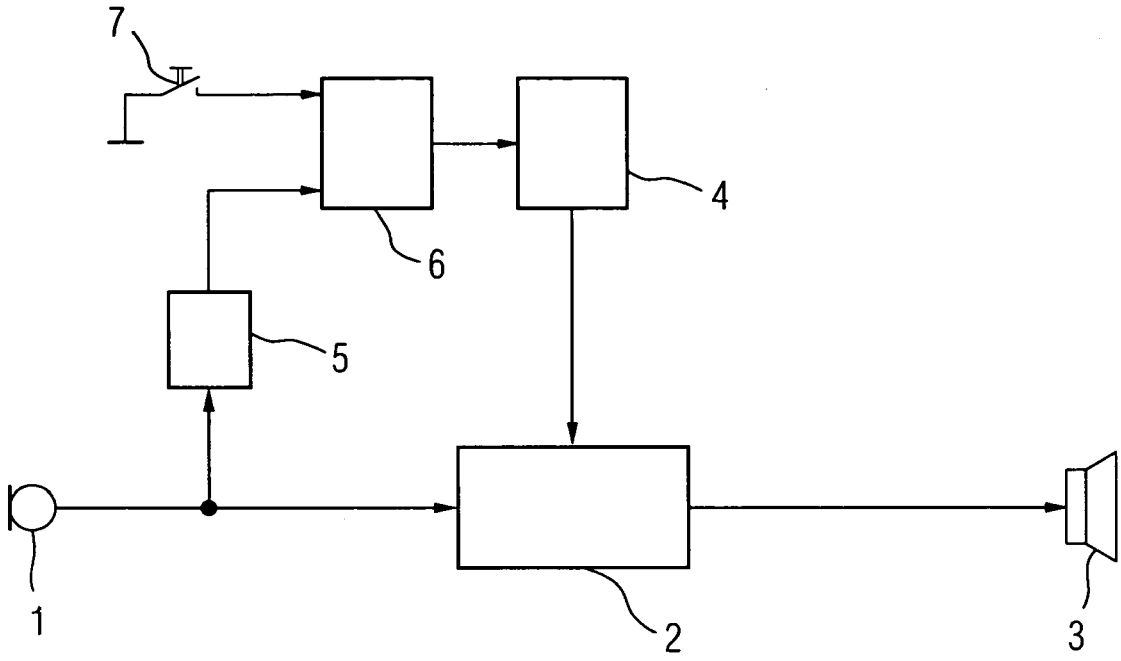
FIG. 1 shows the block diagram of a hearing aid according to the invention.

FIG. 1 shows a hearing aid in a simplified block diagram with a microphone 1 for accepting an acoustic input signal and outputting an electrical signal. The electrical signal is supplied to a signal processing unit 2 for processing and frequency-dependent amplification. The processed signal is finally converted into an acoustic signal by means of an earpiece 2 and supplied to the ear of a hearing aid wearer.

The hearing aid according to the exemplary embodiment further comprises a memory 4 in which a plurality of parameter sets are stored for adapting the signal processing unit 2 to different auditory situations. A parameter set which determines the signal processing for the current auditory situation can thus be selected manually or automatically. For automatic selection, the hearing aid comprises an analysis unit 5, in which the electrical signal emitted by the microphone 1 is analyzed. The analysis unit 5 controls a selection unit 6, by means of which the auditory program best suited to the detected auditory situation is selected. The corresponding parameter set is read out from the memory 5 and transmitted to the signal processing unit 2, thereby determining the signal processing. In accordance with the invention, a specific number of further parameter sets is selected in addition to the selected parameter set, said additional parameter sets similarly containing meaningful parameter adjustments for the current auditory situation. For example, three further parameter sets are selected. The operating device is configured as a key switch 7 in the hearing aid according to the exemplary embodiment. This also supplies a signal to the selection unit 6, the selection unit 6 restricting the selection to the parameter sets suited to the detected auditory situation. According to the invention, actuating the key switch 7 still only switches between a total of four selected parameter sets, in such a manner that based on the parameter set selected automatically and referred to as the first parameter set, a switchover is made to the next parameter set up by reading this set out from the memory 4 and transmitting it to the signal processing unit 2. The preselected parameter sets can be selected in this manner in turn, with a further actuation of key switch 7 selecting the first parameter set again after the fourth selected parameter set. This keeps the operation of the hearing aid simple and manageable, even if a plurality of adjustable parameter sets is stored in the memory 4. By way of example, four respective parameter sets for eight different auditory situations, thus a total of 32 parameter sets, can be stored, from which only the four parameter sets which are suited to the current auditory situation can be selected by means of the key switch 7. The selection function which can be carried out using the key switch 7 is restricted in this exemplary embodiment to the changeover between the four parameter sets which are meaningful to the automatically detected auditory situation.

A preferred embodiment of the invention provides for the adjustments made by a user by actuating the key switch 7 to be detected and evaluated for the different auditory situations, so that the automatic selection is adapted to the user's preferences over the course of time.

The parameter sets for controlling the signal processing are advantageously transmitted to the hearing aid and in particular into the memory 4 by programming the hearing aid by means of an external programming unit (not shown). Furthermore, the adjustment functions assigned to a control element in the respective auditory situation can be determined by programming the hearing aid.

Figure 2:
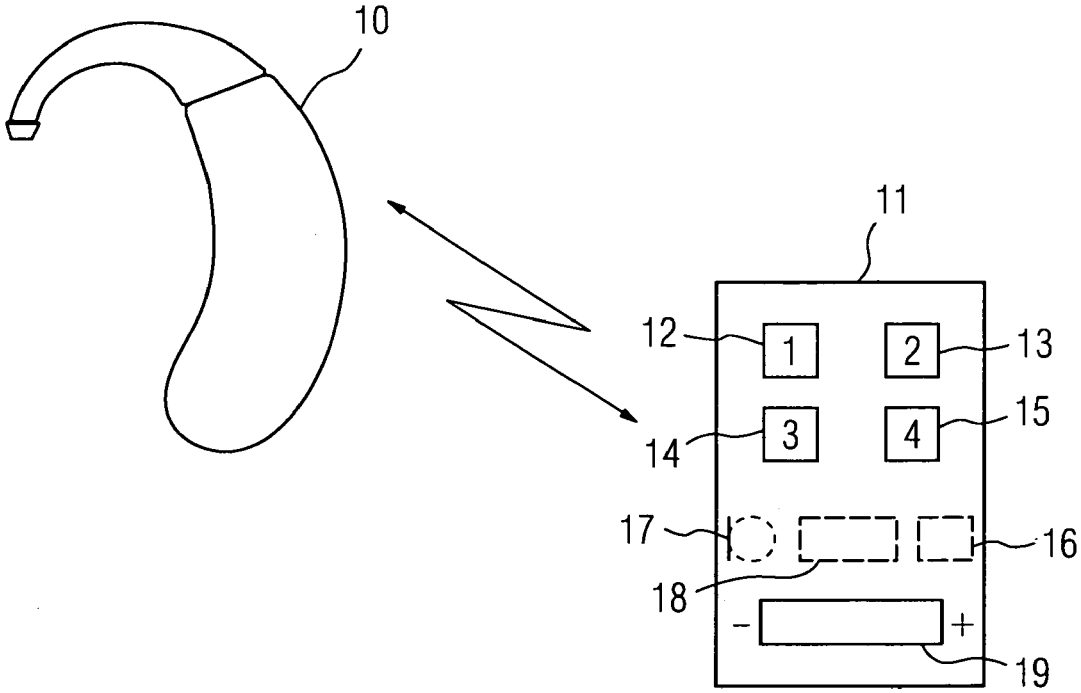
FIG. 2 shows a hearing aid system with a hearing aid and a remote control.

FIG. 2 shows a hearing aid system with a hearing aid 10 wearable behind the ear and a remote control 11. The remote control 11 comprises four program selection keys 12, 13, 14, and 15, and actuating one of these keys reads out from a memory 16 of the remote control 11 the relevant parameter set assigned to the program selection key concerned and transmits it wirelessly to the hearing aid 10. This determines the signal processing in the hearing aid 10 from that point on. A plurality of parameter sets is stored in the memory 16, for example four parameter sets in each instance for eight difference auditory situations. Furthermore, the remote control 11 comprises a microphone 17 and an analysis unit 18, in which the acoustic input signal recorded by the microphone 17 is analyzed. The four parameter sets best suited to the detected auditory situation are preselected and assigned to the program selection keys 12 to 15, as a consequence of the analysis result. A change in the detected auditory situation further results in the parameter set assigned to the program selection key 1 being further automatically transmitted from the remote control 11 to the hearing aid 10, thereby determining the signal processing in the hearing aid. If the user is dissatisfied with this automatically effected adjustment, he is able to choose between three further auditory programs for this auditory situation by actuating the program selection keys 13, 14 and 15.

The remote control 11 according to the exemplary embodiment further comprises a rocker switch 19 which is generally used to change the volume setting. In some auditory situations however the rocker switch 19 performs an adjustment function other than controlling the volume. The rocker switch 19 thus serves to adjust the contrast amplification in the auditory situation 'speech in interference-affected environment'. Different adjustment functions are automatically assigned to the rocker switch 19, as a function of the automatically detected auditory situation.

The invention claimed is:

1. A hearing aid system, comprising:

an input converter for acquiring an input signal and converting the input signal into an electrical signal;

a signal processing unit for processing the electrical signal;

an output converter for outputting an output signal;

an operating device having at least one control element for adjusting a parameter having an impact on at least one signal processing feature implemented in the signal processing unit;

an analysis unit configured to perform a signal analysis on the input signal, wherein a subset of user selectable adjustment functions are assigned to the control element based on the signal analysis; and a memory unit for storing a plurality of adjustment function parameters having an impact on a plurality of signal processing features implemented in the signal processing unit, the plurality of signal processing features related to a plurality of auditory situations, wherein the subset of user selectable adjustment functions are:

continuously user selectable throughout operation of the hearing aid, and pre-selected from the parameters and retrieved from the memory unit based on the signal analysis, and the control element is configured to only increment between the parameters included in the pre-selected subset of parameters.

2. A hearing aid system according to claim 1, wherein a plurality of parameters related to one of the auditory situations is stored in the memory unit.

3. A hearing aid system according to claim 2, wherein the one auditory situation is determined based on the signal analysis, and the pre-selected subset of parameters only includes the parameters related to the determined one auditory situation.

4. A hearing aid system according to claim 1, wherein the operating device is a remote control.

5. A hearing aid system according to claim 4, wherein the analysis unit is included in the remote control.

* * * * *

UNITED STATES PATENT AND TRADEMARK OFFICE

CERTIFICATE OF CORRECTION

PATENT NO. : 7,664,280 B2
APPLICATION NO. : 11/138177
DATED : February 16, 2010
INVENTOR(S) : Uwe Rass It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1301 days.

Signed and Sealed this

Thirtieth Day of November, 2010

David J. Kappos

David J. Kappos
*Director of the United States Patent and Trademark Office*